US005272824A

United States Patent [19]

Cornelius

[11] Patent Number: 5,272,824

[45] Date of Patent: Dec. 28, 1993

[54] TOOTH ASSEMBLY WITH LEAF SPRING RETAINER

[75] Inventor: Erwin D. Cornelius, Bloomington, Ill.

[73] Assignee: Caterpillar Inc., Peoria, Ill.

[21] Appl. No.: 58,087

[22] Filed: May 10, 1993

[51] Int. Cl.[5] ..... E02F 9/28

[52] U.S. Cl. ..... 37/458; 37/456; 37/455

[58] Field of Search ..... 37/142 A, 141 T, 142 R, 37/141 R, 103, 118 R, 458, 456, 455

[56] References Cited

U.S. PATENT DOCUMENTS

| | | | |
|---|---|---|---|
| 3,494,245 | 2/1970 | Helton . | |
| 3,650,053 | 3/1972 | Baer | 37/142 A |
| 3,997,989 | 12/1976 | Stepe . | |
| 4,516,340 | 5/1985 | Launder . | |
| 4,727,663 | 3/1988 | Hahn | 37/142 A |
| 4,965,945 | 10/1990 | Emrich | 37/142 A X |
| 5,009,017 | 4/1991 | Diekevers et al. | 37/142 A |
| 5,068,986 | 12/1991 | Jones | 37/142 A |

FOREIGN PATENT DOCUMENTS

| | | |
|---|---|---|
| 213201 | 11/1956 | Australia . |
| 92/04507 | 3/1992 | World Int. Prop. O. . |

*Primary Examiner*—Dennis L. Taylor
*Assistant Examiner*—J. Russell McBee
*Attorney, Agent, or Firm*—J. W. Burrows

[57] ABSTRACT

Tooth assemblies having a tooth attached to an adapter by a retaining mechanism is normally utilized in order to readily replace the tooth which is a high wear element. It is advantageous to have a retaining mechanism that is both simple, easy to install and remove and provides a high holding force to the pin to offset any tendency of the pin coming out during use. In the subject arrangement, a substantially flat leaf spring retainer is provided and is located in a retainer opening transverse to a pin. Upon installing the pin, the leaf spring is forced to flex. The force needed to flex the leaf spring is likewise the effective force holding the pin in its assembled position. A central groove is defined in the pin and is of a sufficient size to receive the portion of the leaf spring in contact therewith once the pin is in its installed position. Once the leaf spring drops into the central groove, the degree of deflection of the leaf spring is reduced resulting in the life of the leaf spring being increased. By having the retainer opening transverse to the pin opening, the strength of the nose portion is maintained. Likewise, the leaf spring can be made from a substantially flat member.

7 Claims, 3 Drawing Sheets

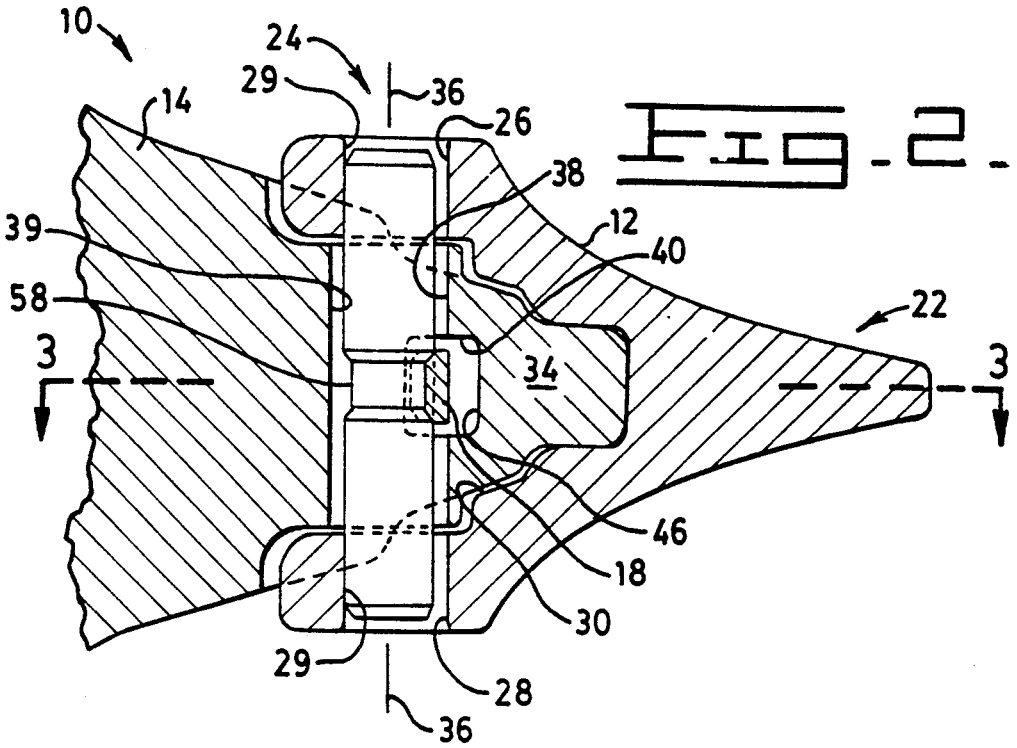
Fig. 2.
Fig. 3.
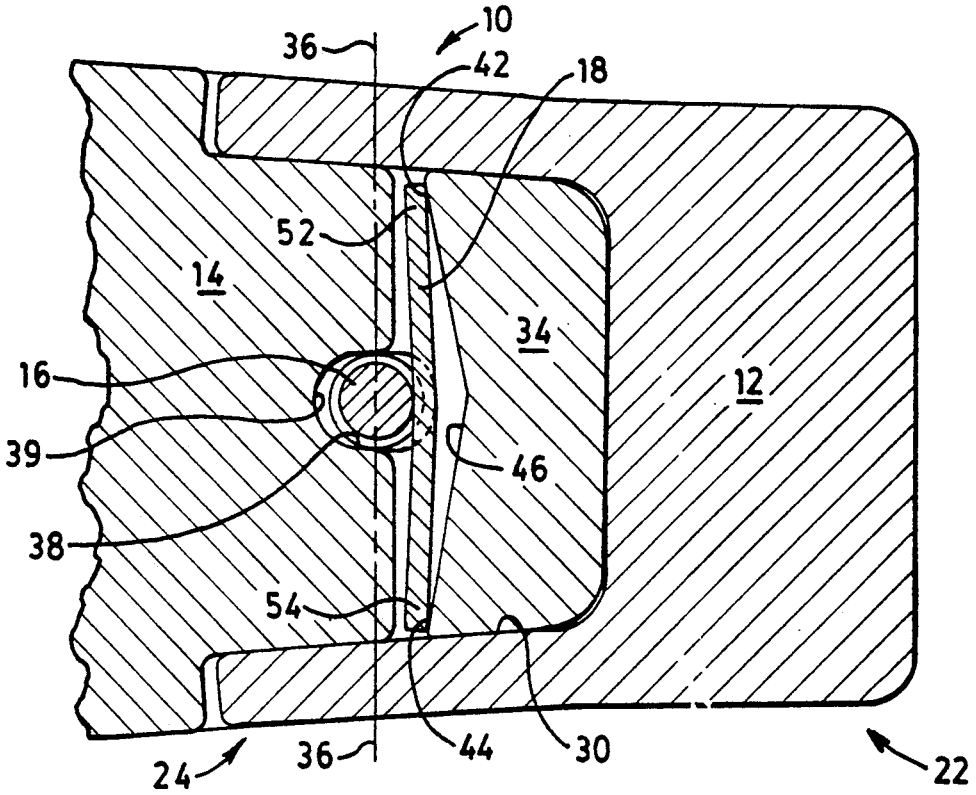

TOOTH ASSEMBLY WITH LEAF SPRING RETAINER

DESCRIPTION

1. Technical Field

This invention relates generally to a tooth assembly having a tooth, an adapter and a retaining mechanism and more particularly to a retaining mechanism including a leaf spring for securing a pin in its assembled position.

2. Background Art

Tooth assemblies normally include a tooth and an adapter which are secured one to the other with some form of a retaining mechanism. In most cases the retaining mechanism includes a pin and some form of retainer to secure the pin in its assembled position. Many different retainers are used to secure the pin in its assembled position. In some of these applications, the retainer is in the form of a bent spring member that is placed in the hole in parallel relationship with the pin and during assembly is forced to be compressed between the side wall of the pin hole and the pin itself, thus, imparting a force on the pin to secure the pin in its assembled position. In these applications, the pin hole is by design made larger to accommodate both the pin and the retainer, thus, weakening the nose of the adapter. Furthermore, in these applications it is difficult to obtain the necessary retaining force on the pin while simultaneously maintaining the useful life of the retainer. By using a bent or formed retainer, it is more difficult to obtain the retaining force needed while simultaneously maintaining the useful life of the retainer. Likewise, the use of a bent or formed retainer would normally require a larger retainer opening, thus, resulting in a weaker cross-section in the nose of the adapter.

The present invention is directed to overcoming one or more of the problems as set forth above.

DISCLOSURE OF THE INVENTION

In one aspect of the present invention, a tooth assembly is provided and includes a tooth, an adapter, a leaf spring, and a pin. The tooth has a pair of aligned openings and a cavity disposed between the respective openings of the pair of aligned openings. The adapter has a nose portion operative to mate with the cavity of the tooth and defines a plane therethrough. A pin opening is aligned substantially along the plane and the retainer opening is offset from and parallel to the plane while being aligned transverse with and intersecting the pin opening. The adapter also has a pair of contact areas located thereon with each one of the pair of contact areas being located on opposite sides of the pin opening. The leaf spring is substantially flat and has opposite end portions and is disposed in the retainer opening of the adapter in operative contact with the pair of contact areas. The pin is disposed in the aligned openings and the pin opening and is operative to secure the tooth to the adapter. The pin is also operative to engage the leaf spring generally between the pair of contact areas forcing the leaf spring to abut the respective contact areas and to forcibly flex the leaf spring, thus, effectively imparting a holding force on the pin. This holding force on the pin urges the pin against portions of the inner surface of the pair of aligned openings or the pin opening.

The present invention provides a tooth assembly that has a retaining mechanism which includes a pin for securing the tooth to the adapter and a transversely disposed substantially flat leaf spring that is effective to impart a retaining force onto the pin to secure the pin in its assembled position and to push the tooth tight onto the adapter nose. By using a substantially flat leaf spring, the size of the opening necessary to locate the leaf spring is reduced. Futhermore, the material removed from the adapter nose to produce the opening for the leaf spring is being removed along the neutral axis of the applied forces. The neutral axis being located substantially mid-way between the upper and lower surfaces of the adapter nose. Consequently, the weakening of the nose portion created by the leaf spring opening is reduced. Likewise, the ability to use a flat leaf spring is enhanced by having the leaf spring opening transverse to the pin opening.

BRIEF DESCRIPTION OF THE DRAWINGS

FIG. 2 is a sectional view of the components of FIG. 1 in their assembled position and taken along a plane parallel to the axis of a retaining pin;

FIG. 3 is a cross-sectional view of the elements of FIG. 1 in their assembled position taken along the line 3—3 of FIG. 2.

BEST MODE FOR CARRYING OUT THE INVENTION

Figure 1:
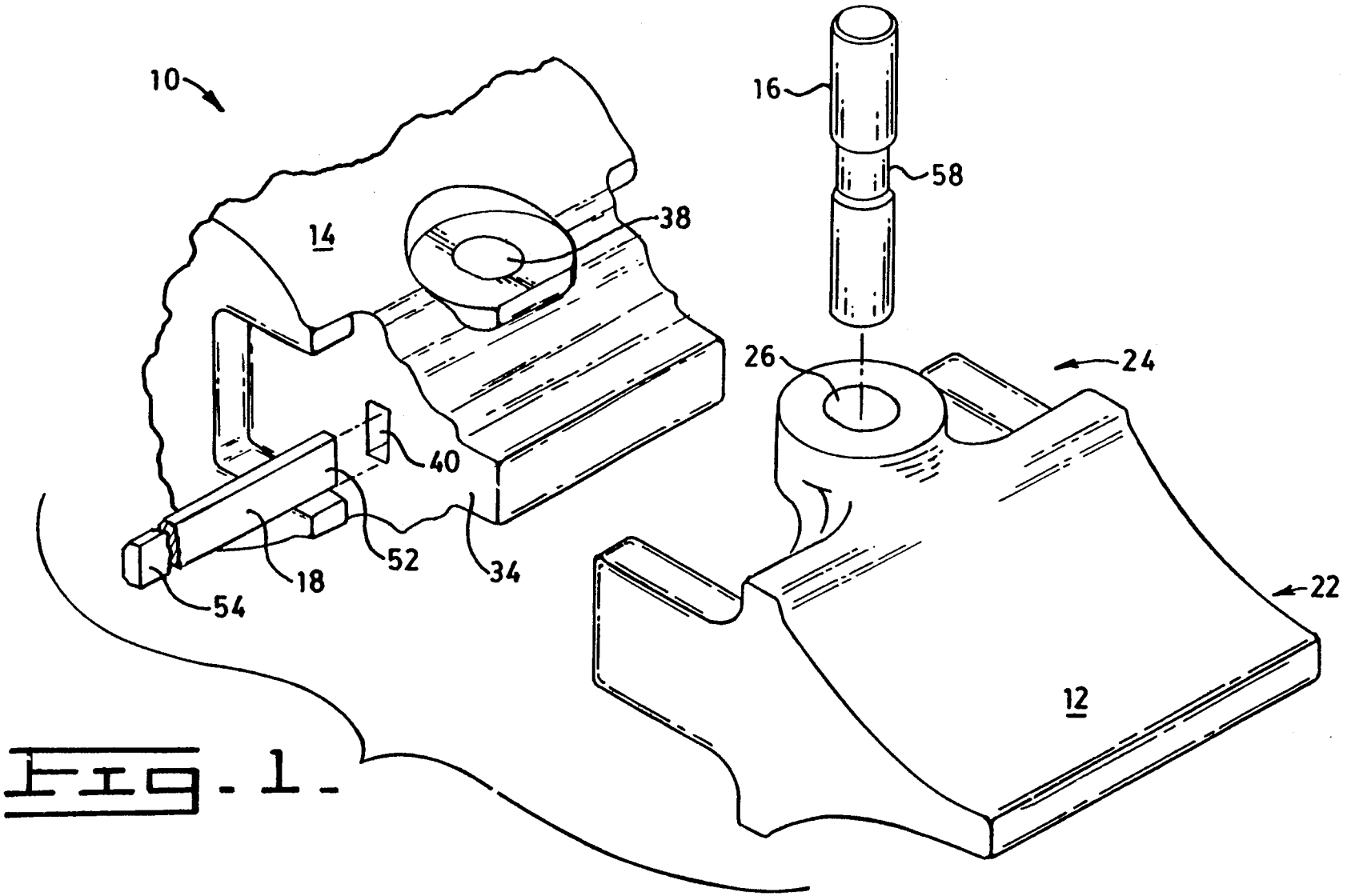
FIG. 1 is a diagrammatic representation of a tooth assembly illustrating all elements in their unassembled condition.

Referring to the drawings, more particularly to FIGS. 1, 2 and 3, a tooth assembly 10 is shown. The tooth assembly 10 includes a tooth 12, an adapter 14, a pin 16, and a substantially flat leaf spring 18. The tooth 12 has a forward end portion 22 operative to engage the material being worked and a rearward end portion 24 operative to connect the tooth 12 to the adapter 14.

A cavity 30 is defined in the rearward end portion 24 of the tooth 12 and extends from the rearward end of the tooth 12 inwardly towards the forward end portion 22. A pair of aligned openings 26,28 having an inner surface 29 is defined in the rearward end portion 24 of the tooth 12 in intersecting relations to the cavity 30.

The adapter 14 has a nose portion 34 defining a pin opening 38 having an inner surface 39 and a transverse vertical plane 36 generally through the center of the pin opening 38. A retainer opening 40 is defined in the nose portion 34 offset from and parallel to the plane 36 and aligned transverse to and intersecting the pin opening 38. A pair of contact areas 42,44 are located in opposite ends of the retainer opening 40. The retainer opening 40 has an inner surface portion which is spaced from and flares away from the plane 36 and extends along the entire length of the retainer opening 40. Beginning at one end of the retainer opening 40, the surface of the portion 46 flares away from the plane 36 to progressively enlarge the retainer opening 40 towards the mid point of the adapter nose 34. From the midpoint of the adapter nose 34 to the opposite end of the retainer opening 40, the surface of the portion 46 flares in a direction towards the plane 36 to progressively decrease the size of the retainer opening 40. The size of the retainer opening 40 at its opposite ends is equal. The pair of contact areas 42,44 are formed generally near the opposite ends of the portion 46.

The flat leaf spring 18 has opposite end portions 52,54 and is disposed in the retainer opening 40. The opposite end portions 52,54 is in operative contact with the pair of contact areas 42,44. The flat leaf spring 18 has a generally rectangular cross-section with the corners along the entire length of one side thereof being beveled. However, it is recognized that the cross section could be rectangular without departing from the essence of the invention.

The flat leaf spring 18 is a steel material having a carbon content of at least 0.5 percent and is hardened in the range of Rockwell C40 to 50. The section modulus of the leaf spring 18 is in the range of 50 mm cubed (0.003 inches cubed) to 940 mm cubed (0.060 inches cubed). The maximum amount of deflection in the leaf spring 18 without permanent deformation is in the range of 3 mm (0.125 inches) to 12.7 mm (0.500 inches). It is recognized that there is a direct linear relationship between the width of the leaf spring 18 and its section modulus. For example, if the width of the leaf spring 18 is increased two times for a given thickness, the section modulus is likewise increased two times. There is also a relationship between the thickness of the leaf spring and the section modulus. For example, if the thickness of the leaf spring 18 is increased two times, the section modulus is increased four times. Likewise, if the thickness of the leaf spring 18 is increased three times, the section modulus is increased nine times. As is well known, this is based on the fact that the section modulus increases as a square of the increase in the thickness of the leaf spring 18. When considering the amount of deflection of the leaf spring 18, for a given length and within its plasticity limits, as the section modulus increases, the amount of deflection decreases. A typical yield strength for the material of the subject leaf spring 18 having a hardness in the range of Rockwell C38-50 is in the range of 1000 MPa (150,000 psi) to 1585 MPa (230,000 psi).

The pin 16 defines a central groove 58 on its peripheral surface and is disposed in the pair of aligned openings 26,28 and the pin opening 38. The pin 16 is operative to secure the tooth 12 to the adapter 14 by engaging the leaf spring 18 generally midway along the length of the leaf spring 18 forcing the opposite end portions 52,54 thereof to abut the respective contact areas 42,44 located at opposite ends of the retainer opening 40. The central groove 58 of the pin 16 has sloped sides operative to mates with the leaf spring 18 allowing it to return towards a normal flat position once the pin 16 has been moved to its fully installed position. The useful life of the leaf spring 18 is substantially increased by allowing the amount of deflection to be lowered. This is true since the life of a material is directly related to the amount of stress that the material is being subjected to for a given period of time. Consequently, if the stress level is high, the useful life is shorter and if the stress level is low, the useful life is longer. Therefore, once the pin 16 is installed the leaf spring 18 is maintained under a lower stress level but in order for the pin 16 to be removed during use or subsequent thereto, a larger force must be applied to cause the leaf spring 18 to flex outward again. The higher stress levels on the leaf spring 18 are being subjected thereto only briefly during installation and removal of the pin 16. Consequently, the useful life of the flat leaf spring is increased.

As illustrated in the subject embodiment, the force of the leaf spring 18 acting on the pin 16 is transferred to the tooth 12 through the inner surface 29 of the pair of aligned openings 26,28 forcing the tip 12 into intimate contact with the adapter nose portion 34. In the subject embodiment, the end of the nose portion 34 is in abutting contact with the tooth 12 at the bottom of the cavity 30. However, it is recognized that the abutting contact between the tooth 12 and the nose portion 34 could be at other locations without departing from the essence of the invention.

Figure 4:
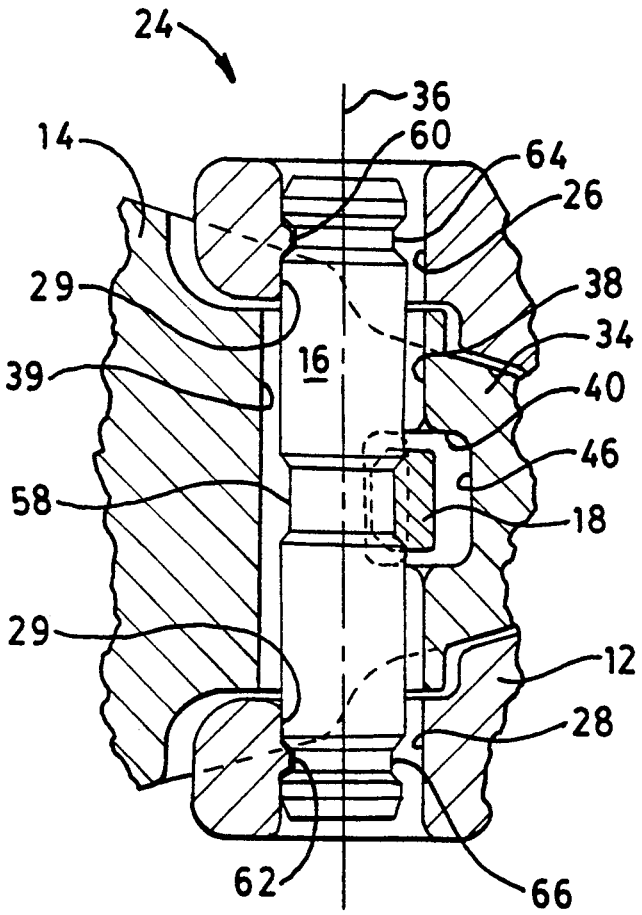
FIG. 4 is an enlarged fragmentory portion similar to FIG. 2 but illustrating another embodiment of the present invention.

Referring now to FIG. 4, another embodiment of the subject invention is illustrated. All like elements have like element numbers. A pair of lugs 60,62 is disposed on the tooth 12. One lug 60 is located in the one aligned opening 26 and extends from the inner surface 29 thereof. The other lug 62 is located in the other aligned opening 28 and extends from the inner surface 29 thereof. Each of the lugs 60,62 is located on a portion of the inner surface on the side of the plane 36 that is opposite to the leaf spring 18.

The pin 16 defines a pair of grooves 64,66 on the peripheral surface thereof. One groove 64 is located adjacent one end of the pin 16 and the other groove 66 is located adjacent the other end of the pin 16. The pair of grooves 64,66 are adapted upon assembly to receive the pair of lugs 60,62 located in the aligned openings 26,28 of the tooth 12. It is recognized that the shape of the lugs 60,62 and their mating grooves 64,66 could be different than that illustrated without departing from the essence of the invention.

It is recognized that various forms of the tooth assembly could be utilized without departing from the essence of the invention. For example, the central groove 58 could be omitted. Likewise, the pair of contact areas 42,44 could be located along the length of the retaining opening 40 inwardly from each end thereof to increase the force needed to deflect the leaf spring 18. Furthermore, even though the invention as previously described includes the tooth 12 being connected to an adapter 14, it is well recognized that the subject invention, as claimed, would also include the connection of an intermediate member to an adapter without departing from the essence of the invention. In systems including a tip, an intermediate adapter and an adapter connected to the implement, the same type of pin and retainer could be utilized to connect the various components. Additionally, even though in the drawings the pin 16 is illustrated as being in contact with the inner surface 29 of the pair of aligned openings 26,28, it is recognized that the pin 16 could be held in contact with the inner surface 39 of the pin opening 38 of the nose portion 34. It is recognized that in this case the tooth 12 would not necessarily be held tightly against the nose portion 34. It is also recognized that the cross sectional shape of the pin 16 could be varied without departing from the essence of the invention. For example, the shape could be square, rectangular, hexagonal, or others. By using shapes other than round, the respective grooves 58,64,66 as required could be simple slots located on one side thereof only.

INDUSTRIAL APPLICABILITY

In the operation of the tooth assembly 10, the leaf spring 18 operates to maintain the pin 16 in its assembled position, thus, securing the tooth 12 to the adapter 14. This is accomplished as follows. The leaf spring 18 is inserted into the retainer opening 40 followed by the tooth 12 being placed on the adapter 14 such that the adapter nose 34 fits into the cavity 30. Once the tooth 12 is mounted on the adapter 14, the leaf spring 18 is trapped within retainer opening 40 by the sides of the tooth 12. The pin 16 is inserted into one of the aligned openings 26,28 and progressively directed into the retainer opening 40 until one end of the pin 16 contacts the leaf spring 18. The leading edge of the pin 16 contacts a corner of the leaf spring 18 inhibiting further movement of the pin 16 into the pin opening 38. An external force is applied to the end of the pin 16 forcing the pin 16 past the leaf spring 18 causing the leaf spring 18 to flex. The leaf spring 18 is forced to flex to a point at which the peripheral surface of the pin 16 passes by the one side of the leaf spring 18 that is in contact with the pin 16. Once the pin 16 reaches its fully assembled position, the leaf spring 18 drops into the central groove 58. At this position, the stress on the leaf spring 18 is lowered and the pin 16 is securely maintained in its installed position. The leaf spring 18 is still in a partial flexed condition such that a continuous force is being applied to the pin 16 and subsequently to the inner surface 29 of the pair of aligned openings 26,28. This force being sufficient to force the tooth 12 to firmly abut the nose portion 34.

Many times during the working of the tooth assembly 10, the tendency of the tooth to move with respect to the adapter is sufficient to cause the pin 16 to attempt to "walk"itself out of its originally installed position. This working force on the pin 16 is offset by the added force necessary to cause the leaf spring 18 to flex to a degree sufficient for the leaf spring to become free of the central groove 58. Consequently, the pin 16 is securely held in its installed condition and an external force must be applied to one end thereof sufficient to flex the pin 18 outwardly to free itself from the central groove 58.

In one example, the flat leaf spring 18 has a hardness of Rockwell C42, a length of 206 mm (8.12 inches), a width of 35 mm (1.38 inches) and a thickness of 6.35 mm (0.25 inches). The material having a yield strength of approximately 1170 MPa (170,000 pounds per square inch). With a deflection of 6.35 mm (0.25 inches), the resulting force on the pin 16 is approximately 5kN (1200 pounds). As previously noted, changes in the steel properties result in changes in the force level acting on the pin 16. For example, if the yield strength of the above noted flat leaf spring 18 is approximately 1585 MPa (230,000 pounds per square inch) with a deflection of 8.6 mm (0.31 inches) and a hardness of approximately Rockwell C50, the resulting force acting on the leaf spring 18 would be approximately 7.2kN (1630 pounds).

Referring to the operation of FIG. 4, the assembly and disassembly of the respective components are the same and the functioning of the various components are the same. However, in the arrangement illustrated in FIG. 4, in order to assembly and/or remove the pin 16, a larger external force has to be applied assuming the various components are of the same size and of the same materials of that described with respect to FIGS. 1-3. The added force is necessary since the pin 16 must be moved to one side of the pair of aligned openings 26,28 in order for the pair of grooves 64,66 to be moved to a position to receive the pair of lugs 60,62. This extra off-center movement likewise results in the leaf spring 18 being forced to deflect a greater amount which increases the force needed to cause the extra deflection of the leaf spring 18. Even though FIG. 4 shows a pin 16 having a central groove 58 and a pair of grooves 64,66 located thereon, it is recognized that the central groove 58 could be eliminated without departing from the essence of the invention. Furthermore, it is recognized that only one lug 60 and one corresponding groove 64 could likewise be utilized without the need of the other lug 62 and corresponding groove 66 and/or the central groove 58.

In view of the foregoing, it is readily apparent that the structure of the present invention provides a tooth assembly having a retaining mechanism that is both simple in construction and is sufficient to provide high retaining forces to the pin that is securing the tip to the adapter. Additionally, by having the retaining opener 40 transverse to the pin opening 38, a flat leaf spring 18 can readily be utilized.

Other aspects, objects, and advantages of this invention can be obtained through a study of the drawings, the disclosure, and the appended claims.

I claim:

1. A tooth assembly, comprising:

a tooth defining a pair of aligned openings each having an inner surface and a cavity disposed between the respective openings of the pair of aligned openings;

an adapter having a nose portion operative to mate with the cavity of the tooth and defining a pin opening having an inner surface and a transverse vertical plane therethrough, the pin opening being aligned substantially along the plane, a retainer opening offset from and parallel to the plane and aligned transverse to and intersecting the pin opening and having a pair of contact areas located on the nose portion with each one of the pair of contact areas being located on opposite sides of the pin opening;

a substantially flat leaf spring having opposite end portions and being disposed in the retainer opening in operative contact with the pair of contact areas; and a pin disposed in the pair of aligned openings and the pin opening and being operative to secure the tooth to the adapter, to engage the leaf spring generally between the pair of contact areas forcing the leaf spring to abut the respective contact areas, and to flex the leaf spring, thus, effectively imparting a holding force on the pin urging the pin against portions of the inner surface of the pair of aligned openings or the inner surface of the pin opening.

2. The tooth assembly of claim 1 wherein the leaf spring is a steel material having a hardness in the range of Rockwell C40 to 50.

3. The tooth assembly of claim 2 wherein the section modulus of the leaf spring is in a range of 50 mm cubed to 1200 mm cubed.

4. The tooth assembly of claim 3 wherein the maximum amount of deflection in the leaf spring is in the range of 3 mm to 12.7 mm.

5. The tooth assembly of claim 4 wherein the force form the leaf spring against the pin urges the pin against the portions of the inner surface of the pair of aligned openings in the tooth resulting in the tooth being held firmly against the adapter.

6. The tooth assembly of claim 5 wherein the tooth has a pair of lugs, one of the lugs being located on a portion of the inner surface of one of the aligned openings and the other lug being located on a portion of the inner surface of the other of the aligned openings, each of the lugs being located on the portion of the inner surface of the respective aligned openings on the side of the plane 36 opposite to the leaf spring, and the pin has a pair of grooves defined on the peripheral surface thereof, one of the grooves being located adjacent one end of the pin to receive the one of the lugs and the other of the grooves being located adjacent the other end of the pin to receive the other of the lugs.

7. The tooth assembly of claim 6 wherein the pin has another groove defined in the outer peripheral surface generally midway along the length of the pin and operative to receive the portion of the leaf spring that is in contact with the pin so that the deflection of the leaf spring in the fully installed position is reduced, thus, increasing the life of the leaf spring.

* * * * *